United States Patent [19]

Castleton

[11] Patent Number: 4,598,482

[45] Date of Patent: Jul. 8, 1986

[54] RAFTER CUTTING TEMPLATE AND TAPE

[76] Inventor: Thomas E. Castleton, P.O. Box 81, Moss Beach, Calif. 94038

[21] Appl. No.: 792,133

[22] Filed: Oct. 28, 1985

[51] Int. Cl.[4] ..... B43L 7/00

[52] U.S. Cl. ..... 33/482; 33/563; 83/745; 144/144.5 R

[58] Field of Search ..... 33/1 B, 416, 417, 482, 33/562, 563, 566; 83/761, 745; 144/144 R, 144.5 R

[56] References Cited

U.S. PATENT DOCUMENTS

| | | | |
|---|---|---|---|
| 1,821,103 | 9/1931 | Luginbuhl | 33/417 |
| 1,980,765 | 11/1934 | Sloper | 33/417 |
| 4,128,030 | 12/1978 | Kundikoff | 83/745 |
| 4,404,753 | 9/1983 | Klok | 33/482 |

*Primary Examiner*—Francis S. Husar
*Assistant Examiner*—Jorji M. Griffin
*Attorney, Agent, or Firm*—Allston L. Jones

[57] ABSTRACT

A rafter cutting template and guide for laying out each type of roof rafter for a selected roof pitch given the zero pitch length of the rafter. The template includes a body portion and wing means attached thereto. The body portion is shaped so that each end includes the necessary angles so that its edges can be used for marking the plumb cut line, seat cut and tail lines for each of the types of rafters that that end is designed to lay-out for the selected roof pitch. The body portion also includes means for converting the zero pitch length of each type rafter to the actual length for the selected pitch of the roof. The wing means is affixed perpendicularly to the top edge of the body portion and fulfills two functions. The wing means provides a right angle surface to snug the template against the edge of the stock to be marked for cutting into a rafter, as well as, providing a means to mark the hip rafters for backing and to provide the side cut angles for the jack, cripple jack, hip and valley rafters for the selected roof pitch.

13 Claims, 14 Drawing Figures

RAFTER CUTTING TEMPLATE AND TAPE

BACKGROUND OF THE INVENTION

This invention relates to cutting of roof rafters, and, more specifically, to a template and tape to facilitate the measurement and cutting of all necessary rafters for a sloping roof given the desired pitch and a zero pitch rafter plan.

Traditionally, a carpenter cuts out the rafters for a structure using a framing square, a carpenter's tape, a look-up table for the desired pitch from any of several available rafter books, and the zero pitch roof plan (see FIG. 1) from which the run of each rafter is given or can be obtained by measuring the drawing. This method is time consuming and requires a good deal of manipulation of the framing square and addition of the table entries for the actual length of the rafter, given its pitch and run length. It can easily be seen that there are many sources of potential error in this method, namely errors in manipulating the framing square, finding the correct tables for the desired pitch, and properly reading and adding the resultant numbers from those tables.

There are at least three templates which have been designed to replace the framing square, however, one must still rely on the rafter book and the carpenter's tape to determine the necessary rafter lengths and to make the necessary measurements. In addition, the carpenter must use two different templates, or readjust the template angles, to cut all of the various types of rafters which make up the roof. U.S. Pat. Nos. 2,965,969 (Haley) and 3,183,596 (Shaw) are for a template that is fixed for a particular pitch, and 3,304,614 (Adams) discloses a template that is adjustable for various pitches. Each of these templates continue to force the carpenter to rely on the standard rafter book, while injecting another potential for error. Namely, the requirement that one template or setting be used when cutting common or jack rafters, and a second template or setting be used when cutting hip and valley rafters. By doing so there is a good chance that the wrong second template or setting for the wrong pitch could be selected resulting in lost time and waste of lumber.

It would be desirable to have a single template which incorporates the ability to make all of the rafters of a structure without the need to refer to the standard rafter book or to make extensive calculations. It would also be helpful to include with the template a tape with a scale which is expanded by a factor that corresponds to the selected pitch so that the rafters can be measured with that scale, using only the run measurement from the zero pitch roof plan without conversion to the actual rafter length.

SUMMARY OF THE INVENTION

In accordance with the illustrated embodiment, the present invention provides a rafter cutting template and guide for laying out each type of roof rafter for a selected roof pitch given the zero pitch length of the rafter. The template includes a body portion and wing means attached thereto. The body portion has a straight top edge, a first and a second side edge each making an acute included angle with one and the other end of the top edge, respectively, a first and a second seat cut guide surface with each being at a right angle with the end of the first and second side edges away from the top edge, respectively, and extending toward each other, and first and second side edge extensions each being at a right angle with the first and second side cut guide surfaces, respectively, and extending away from the top edge. The wing means is attached perpendicularly to the top edge of the body portion for abutting the stock from which the rafter is to be cut. The acute included angles are the plumb cut angles for the rafters to be laid out and cut using the corresponding first or second side edge.

The template also includes means for converting the zero pitch length of each rafter to an actual length for the selected roof pitch. In the first embodiment the length conversion means is a combination of a table and scale means for the various types of rafters. In the second embodiment the length converting means includes a dual scale, dual sided, rolled tape affixed to the template intermediate the first and second side edges with the tape disposed to extend adjacent the top edge to and beyond either of its ends. Each side of the tape, like the scales in the first embodiment, are marked with one set of divisions in standard inches and fractions thereof, and another set of divisions in expanded inches and fractions thereof adjacent the one set of divisions with the expanded scale on the visible side of the tape when the tape is extended toward one or the other end of the top edge is expanded by a factor to convert the zero pitch length to the actual length for the selected roof pitch for the type of rafters to be laid out using the side edge of the template toward which the end of the tape is extended.

The wing means include a different polyhedron wing adjacent each end of the top edge of the body portion. Each wing includes a designation of the side cut angle for the selected pitch of the roof of the corresponding rafter to be cut using the end of the template to which the wing is connected. One of the wings also includes a plurality of marking holes selectively spaced away from at least one side of the body portion to accommodate various thickness of rafter stock. These holes are for marking hip rafters for backing.

Additionally, seat cut guides can also be provided for various widths of rafter stock, e.g. 2"×4", 2"×6", etc. Further, the seat cut guides for hip rafters can also be designed to allow for the deeper seat cuts for unbacked hip rafters, as well as, for the backed hip rafters.

DESCRIPTION OF THE PREFERRED EMBODIMENTS

In the following discussion, the reference numbers assigned to the various portions of the various embodiments will be repeated whenever possible to facilitate the understanding of the similarities and differences of those embodiments of the present invention.

Figure 1:
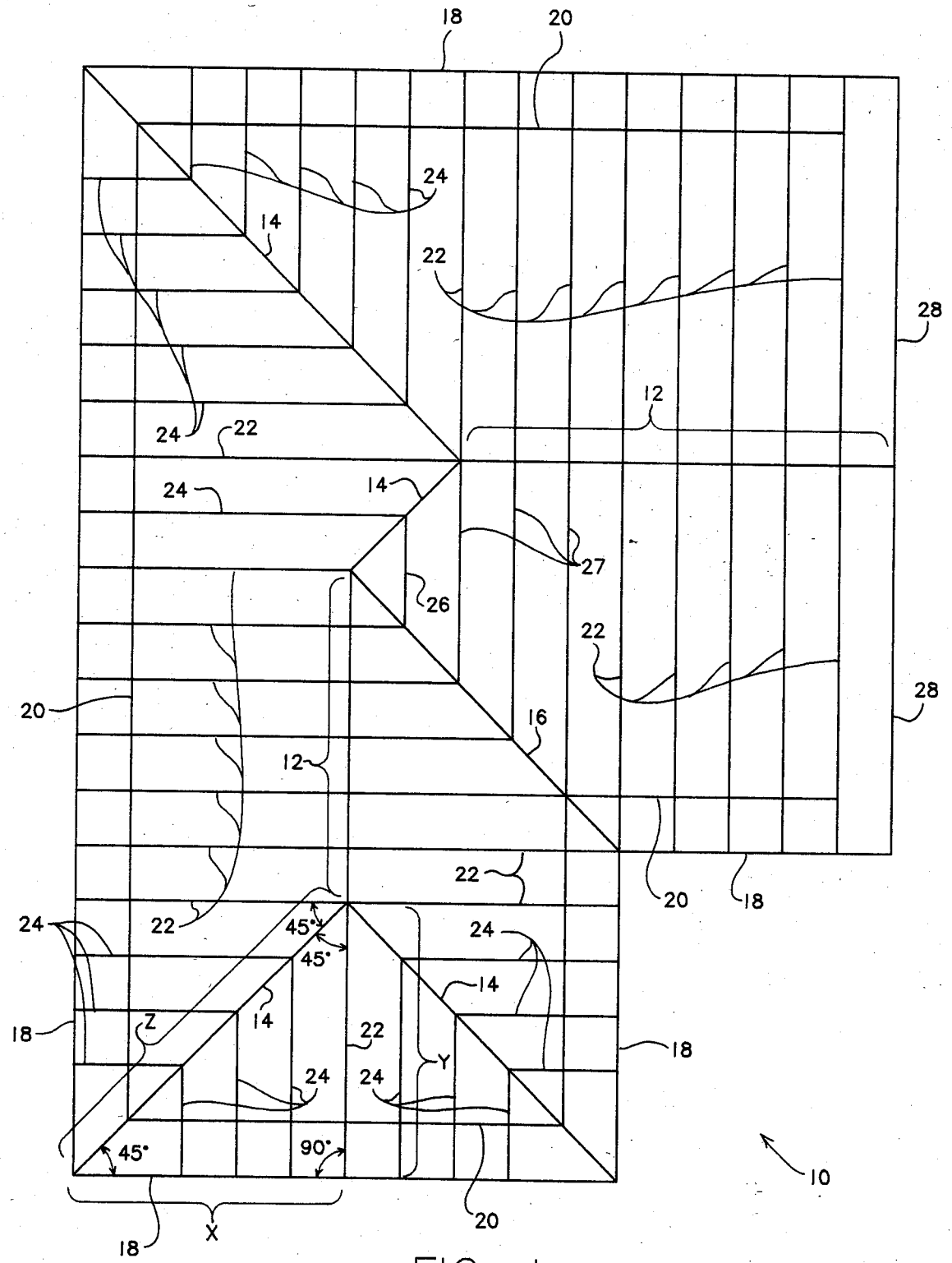
FIG. 1 is a sample zero pitch roof plan.

Referring to FIG. 1, there is shown a zero pitch roof design 10 wherein each of the elements of the design have zero width and only their horizontal run dimension is drawn to scale. The actual length of each of the roof elements, except for the ridge, top plate and facia boards which remain horizontal for all pitches, is dependent on the pitch selected for the finished roof. Given the zero pitch roof design 10 and the desired pitch, one can build the roof by traditional means or more simply by means of the present invention. In FIG. 1, the roof plan includes ridges 12, hip rafters 14, valley rafter 16, facia boards 18, top plate 20, common rafters 22, jack rafters 24, a cripple jack rafter 26, valley jack rafters 27, and verge rafters 28.

Next, in FIGS. *2a–c*, there is shown several views of a first embodiment of the rafter template of the present invention for a roof which has a 6 and 12, or a 26½° pitch (12″ run for 6″ rise). In the side view of FIG. *2a*, it can be seen that the template resembles a bird wherein the left wing is larger than the right wing. In this figure the right end of the template is designed to be a guide edge 36 for making plumb cuts for the common and jack rafters, and for making the seat cut 32 and 34 where the rafter rests on the top plate for either 2″×4″ or 2″×6″ stock respectively. To facilitate the marking of the seat cuts, the height of the template main body 70 is substantially equal to the nominal height of the largest stock with which the template is to be used (2″×6″ in the present example). In addition, a table 30 provides a conversion of the run dimension for a common or jack rafter, from the zero pitch roof plan 10 to the actual length of that rafter for a pitch of 6 and 12. Further, a dual scale 38 is shown with a standard scale 40 (1″=1″) aligned beside an expanded scale 42 wherein an inch is expanded as a function of the selected pitch. Angle "A" in the upper right corner is also dependent on the selected pitch of the roof to be constructed.

In the lower right portion of FIG. *2a*, a right triangle is shown with its horizontal component labeled "RUN(R)", its vertical component labeled "RISE(H)" and the hypotenuse labeled "L". Thus, $$\text{Angle } A = \tan^{-1}\frac{R}{H} \tag{1}$$

where R is the horizontal component of the selected pitch (e.g. 12″) and H is the vertical component of the selected pitch (e.g. 6″). Thus, for a 6 and 12 pitch roof, A=63½°. In addition, $$L = \frac{R}{\text{Sin}(A)} \tag{2}$$

where L is the actual length of the rafter, R is the run length measured from the zero pitch roof plan 10, and A is the plumb angle determined in equation (1). From equation (2) it can be seen that the expansion factor necessary to create expanded scale 42 is (1/Sin(A)). Thus, for a 6 and 12 pitch roof (A=63½°) the expansion factor is 1.118. Stated another way "1" on the expanded scale 42 is actually equal to 1.118 standard inches or 11.8% longer to accommodate for the selected pitch of the roof. Alternately, angle A and the expansion factor for the selected pitch can be derived from a book of rafter tables.

FIG. *2b* shows the other side, or the back, of the main body 70 of the first embodiment of the template of the present invention. In this figure the right end of the template is designed to be a guide edge 50 for making plumb cuts for hip and valley rafters, and for making seat cuts 46 and 48 for either 2″×4″ or 2″×6″ stock, respectively. Each of seat cut guides 46 and 48 include two depths for the seat cut for each stock size. This is necessary since an unbacked hip rafter must be seated lower to prevent the edges of that rafter from extending above the nominal surface of the other rafters. The full depth 58 and 62 of seat cut guides 46 and 48 are for use in cutting an unbacked hip rafter and the standard seat cut positions 60 and 64 of seat cut guides 46 and 48 are for use in cutting valley and backed hip rafters. In addition, a table 44 provides a conversion of the run dimension of a valley or hip rafter from the zero pitch roof plan 10 to the actual length of that rafter for a pitch of 6 and 17. Note, that for the same roof design, the pitch of the valley and hip rafters is different from the pitch of the other rafters. This will be explained below. Further, a dual scale 52 is shown for the pitch of the valley and hip rafters with a standard scale 54 aligned beside an expanded scale 56 wherein an inch is expanded as a function of the pitch of the rafters. Angle B in the upper right corner is also dependent on the selected pitch of the roof to be constructed.

Since the hip and valley rafters do not intersect the ridge at 90°, their pitch is less than the perpendicular pitch of the finished roof. In the lower left corner of the roof plan of FIG. 1, hip rafter 14 can be seen to be at 45° to ridge 12. Hip 14 can also be seen to be traversing the same front to back horizontal distance as common rafter 22 in the center of the bottom portion of the roof plan, thus it must have a smaller pitch. Using the Pythagorean Theorem we know that:

$$Z^2 = X^2 + Y^2 \tag{3}$$

and thus for a 45° right triangle $$X = Y \tag{4}$$

$$Z = (\sqrt{2})X \tag{5}$$

Therefore, if the perpendicular pitch of the roof is selected to be 6 and 12, X=12, then $$Z = (\sqrt{2})12 = 16.97056 \tag{6}$$

which is generally rounded off to 17 giving the hips and valleys a pitch of 6 and 17 to correspond to the 6 and 12 pitch of the other rafters. Thus, the conversion factor in this example is $\sqrt{2}$.

Figure 2A:
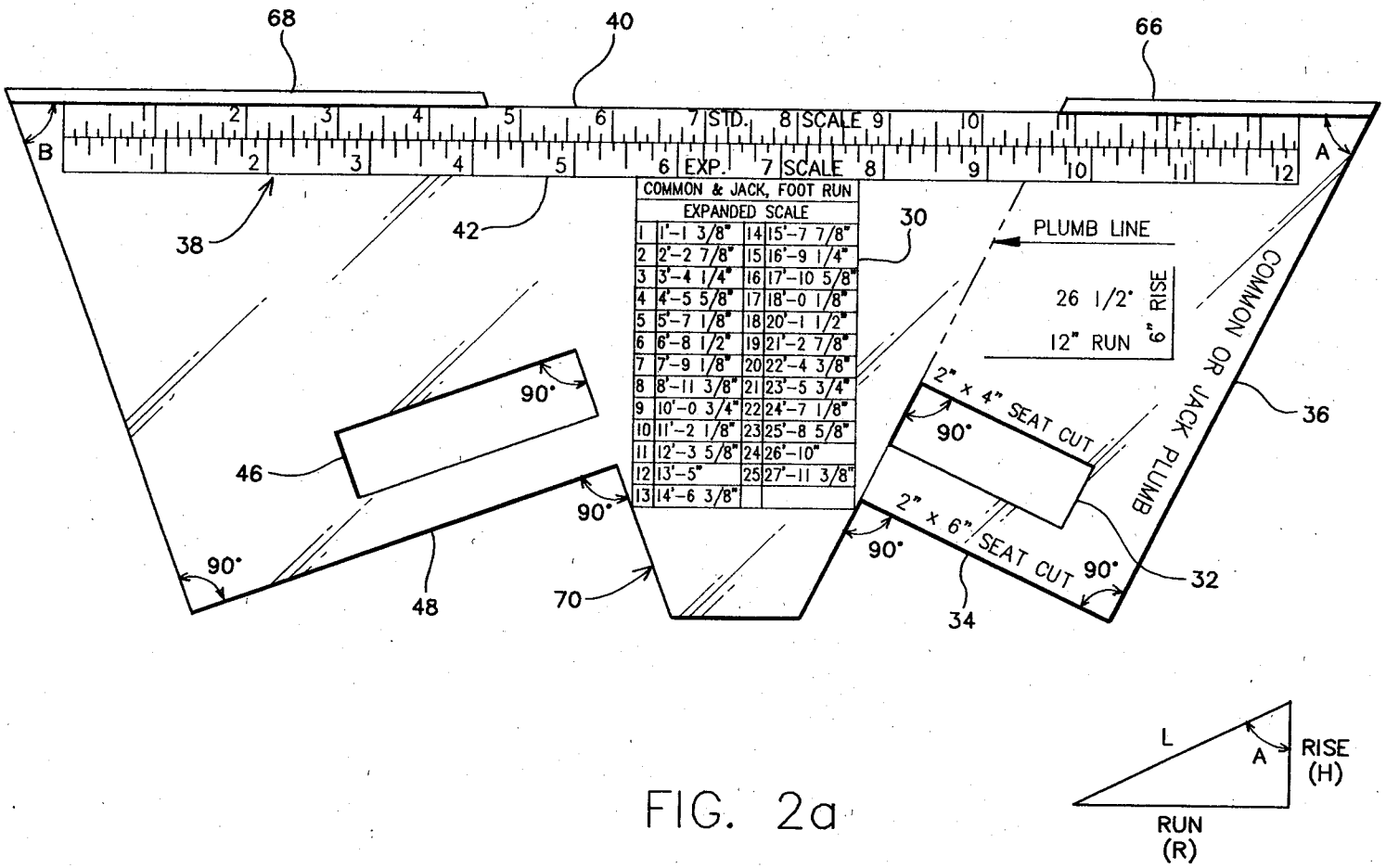
FIGS. 2*a–c* are front, back and top plan views, respectively, of a first embodiment of the rafter template of the present invention.
Figure 2B:
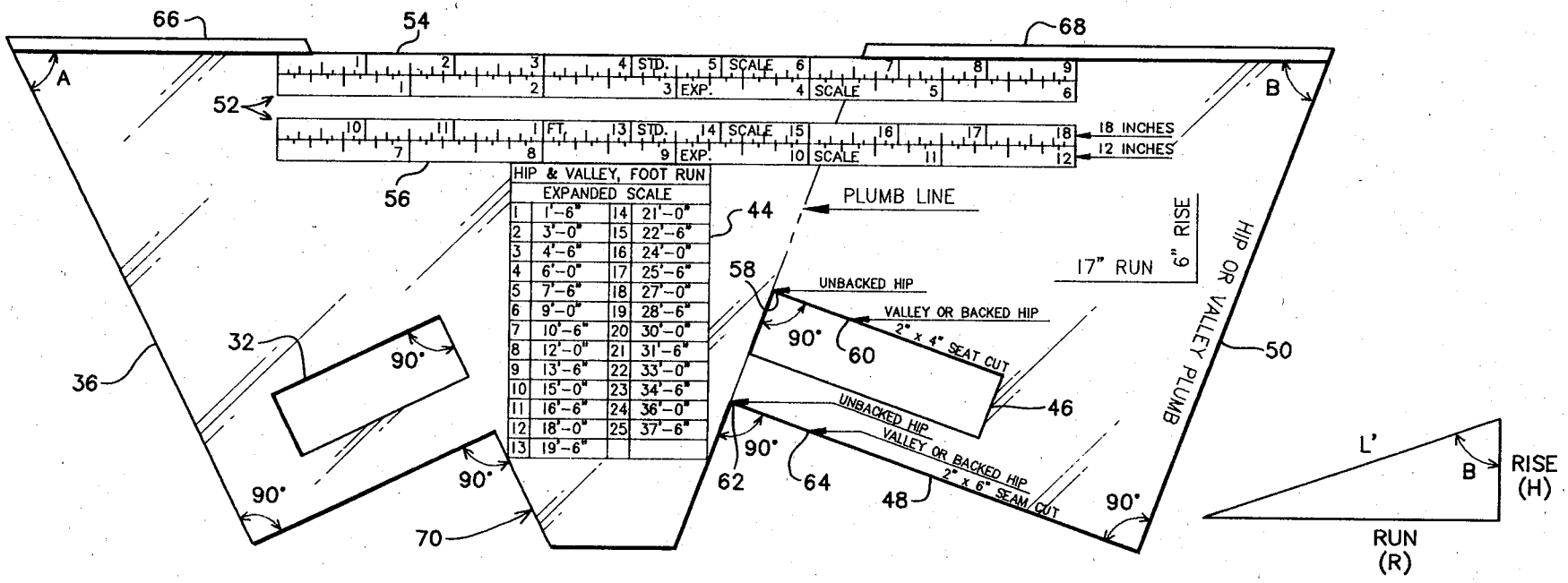

In the lower right portion of FIG. *2b* a right triangle is shown with its horizontal component labeled "RUN(R)", its vertical component labeled "RISE(H)" and the hypotenuse labeled "L'". Thus, $$\text{Angle } B = \tan^{-1}\left(\frac{R\sqrt{2}}{H}\right) \tag{7}$$

where R and H are the run and rise components of the perpendicular pitch of the roof (e.g. 12 and 6 in FIGS. 2*a–b*). Thus, for a 6 and 12 pitch roof, B=70°39′ and $$L' = \frac{R'}{\text{Sin}B} \quad (8)$$

where L′ is the actual length of the hip or valley rafter, R′ is the actual horizontal length of the hip or valley rafter measured from the zero pitch roof plan 10, and B is the plumb angle determined in equation (7). From equations (5) and (8) it can be seen that the expansion factor necessary to create expanded scale 56 is ($\sqrt{2}$/SinB). Thus, for a 6 and 12 pitch roof (B=70°39′) the expansion factor is 1.4866. Restated, "1" on the expanded scale 56 is actually equal to 1.4866 standard inches or 48.66% longer than a standard inch to accommodate for the selected overall roof pitch. Alternately, the angle B and this expansion scale can be derived from a book of rafter tables.

Figure 2C:
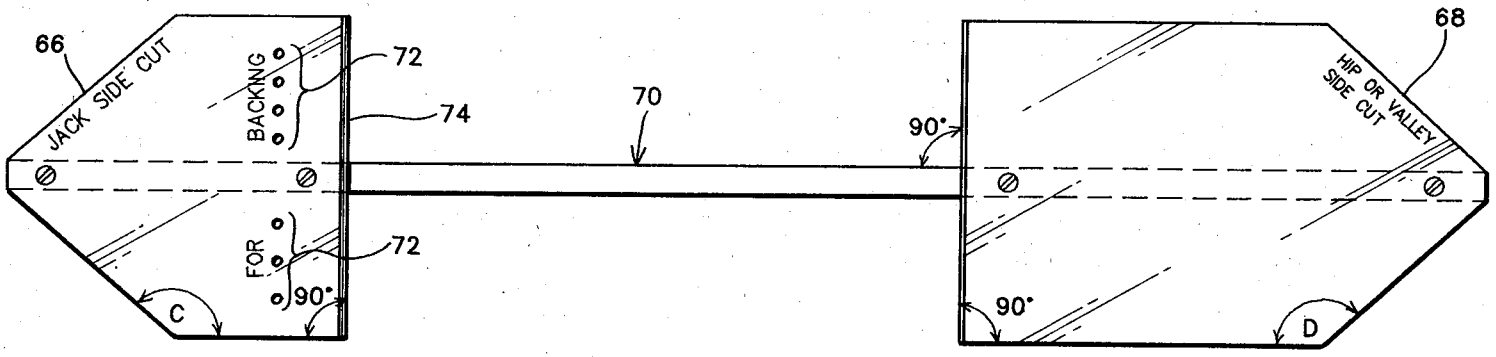

FIG. 2*c* shows two miter wings 66 and 68 affixed perpendicularly to the main body 70 of the template. One is a jack rafter miter wing 66 and the other is a hip and valley rafter miter wing 68. The outer ends of both wings 66 and 68 are bevelled with included angles C and D being selected to be the required sidecut angle for the jack rafters or the hip and valley rafters, respectively. These side cut angles vary from 45° for a roof with a zero pitch (horizontal) to 0° for a roof with an infinite pitch (vertical). The side cut angles for the selected pitch can be obtained from standard rafter tables. For 6 and 12 pitch C=41°54′ and D=43°21′. Additionally, jack miter wing 66 includes means for marking the hip rafters for the degree of backing necessary for various actual thicknesses of stock and the selected pitch of the roof, however, it could just as well be on the hip and valley miter wing 68. That means takes the form of a variety of marking holes 72 on either side of the main body 70 of the template. The spacing of marking holes 72 from body 70 depends on two factors; the thickness of the material (e.g., the nominal thickness of a 2×4 or 2×6 of 1⅝″) and the pitch of the roof. To accommodate for a variety of stock thicknesses, the backing holes 72 on one side of main body 70 are spaced in selected multiples of an ⅛″ from main body 70, and on the other side of main body 70 backing holes 72 are spaced in selected odd multiples of 1/16″ from the main body 70. For a 6 and 12 pitch roof, the backing angle is 126° 56′, and for 1⅝″ thick stock the backing hole 72 needed is 5/16″ out from main body 70. The backing angle varies from 90° (no backing) for a zero pitch (horizontal) roof to 45° for an infinite pitch (vertical) roof.

Figure 3A:
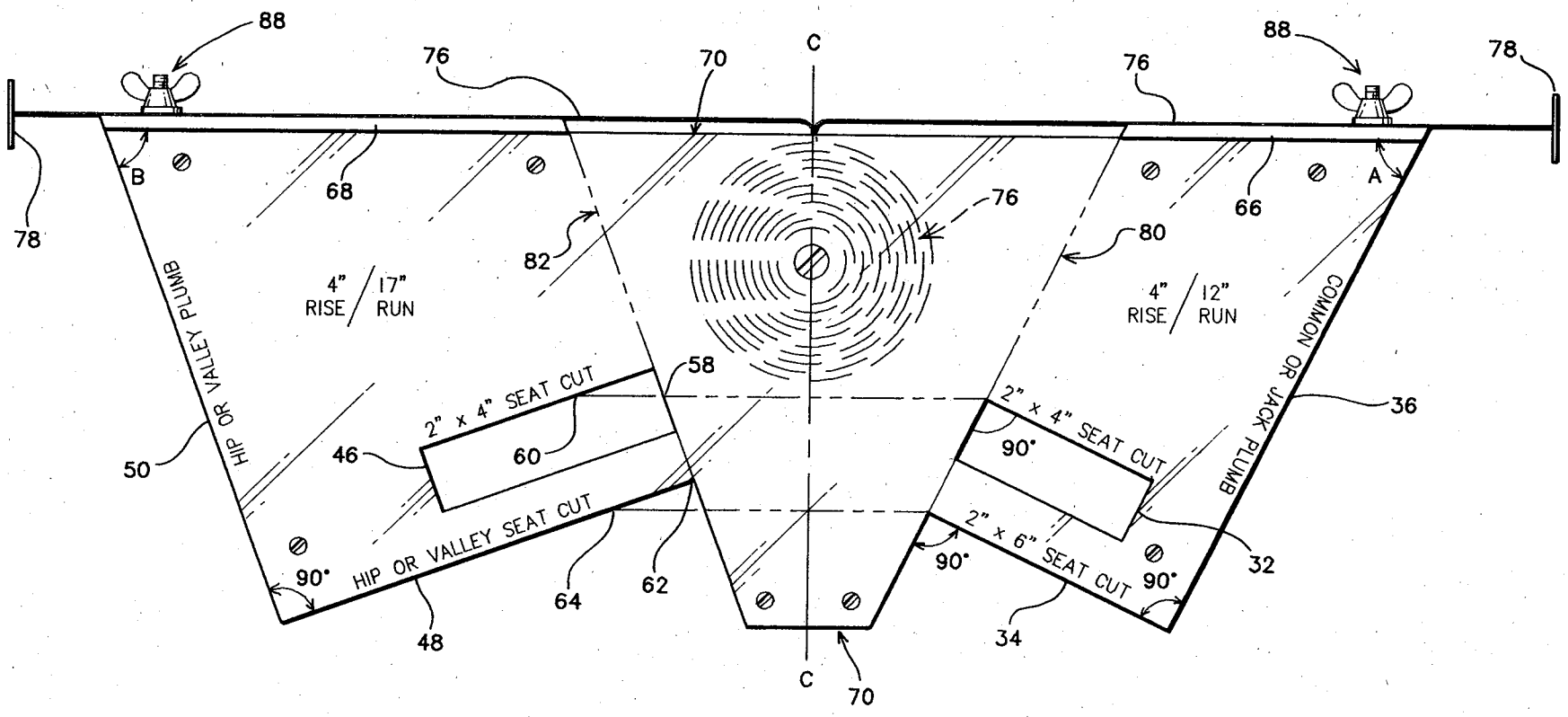
FIGS. 3*a–c* are front, top and end plan views, respectively, of a second embodiment of the rafter template of the present invention which incorporates a dual scale tape of the present invention.
Figure 3B:
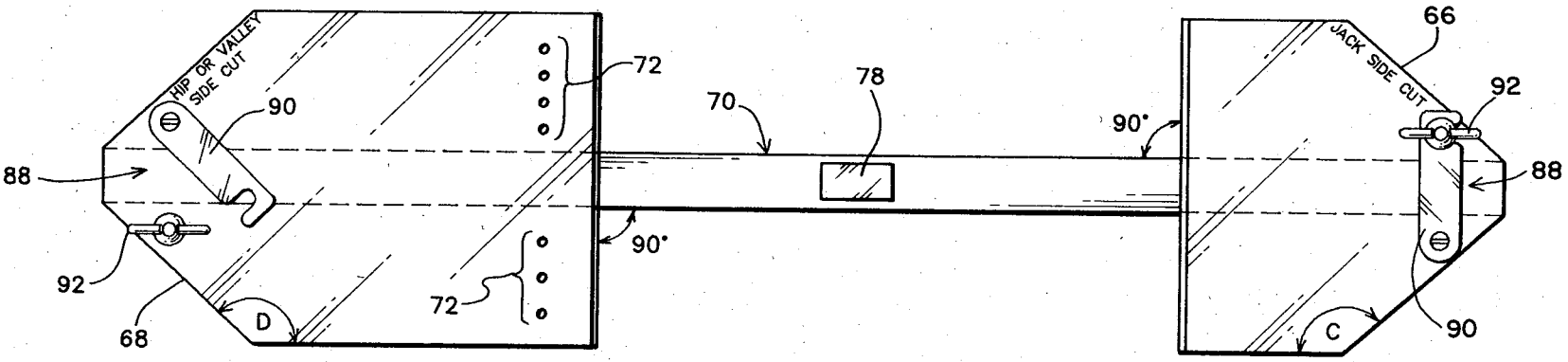
Figure 3C:
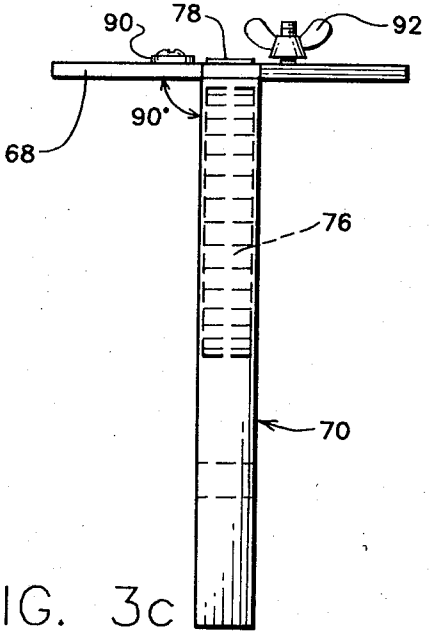

Next, FIGS. 3*a–c* show a second embodiment of the rafter template of the present design. In this embodiment, the tables 30 and 40, and scales 38 and 52 have been replaced by a coiled dual scale dual sided tape 76 and tape locks 88. Tape 76 is marked with a standard and an expanded scale on both sides and oriented in body 70 so that when it is extended to either plumb cut guide 36 or 50 the appropriate expanded scale is readable. Each of tape locks 88 include a wing nut 92 and a swivelly mounted locking plate 90 which is notched to couple with the threaded shaft on which wing nut 92 is mounted. All of the other features of the first embodiment template of FIGS. 2*a–c* are incorporated into the second embodiment and bear the same reference numbers in FIGS. 3*a–c* as in FIGS. 2*a–c*.

Figure 4:
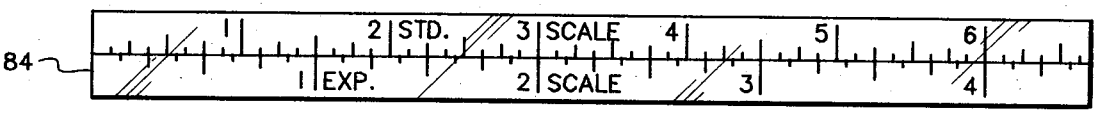
FIG. 4 is a segment of a first design of the dual scale tape of the present invention.
Figure 5:
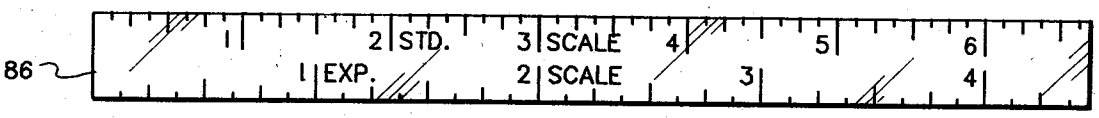
FIG. 5 is a segment of a second design of the dual tape of the present invention.

FIGS. 4 and 5 show two different dual tape or scale configurations for tape 76. Center division dual scale tape 84 is believed to be easier to read than the edge division dual scale tape 86 configuration. A more accurate reading of the actual length from a measurement with the expanded scale can be read from the center division configuration. Why one may need to do this will become clear from the discussion of the method of use of the template from the following discussion.

Figure 8:
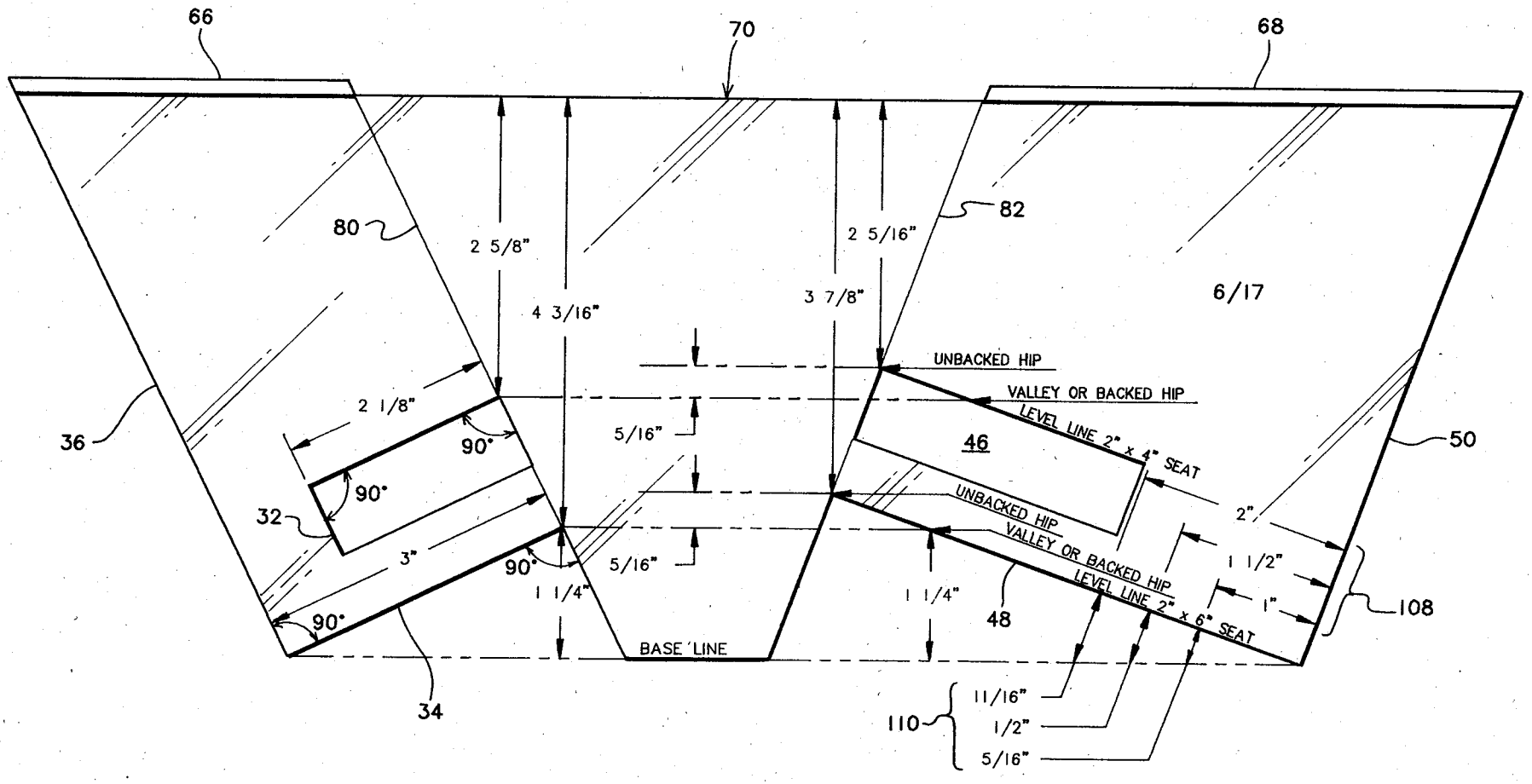
FIG. 8 is a back plan view of a rafter template of the present invention showing the placement of seat cut guides one with respect to the other.

Referring next to FIG. 8 there is a back view of a template of the present invention showing typical placement of the seat cut portions 32, 34, 46 and 48. The purpose of the seat cut in the rafter is to provide a place along the bottom edge of a rafter to rest snug against the top plate 20. Thus, the angle of the seat cut must correspond to the selected pitch of the roof. It is also important to leave sufficient stock between the top edge of the rafter and the deepest point of the seat cut so that the finished rafters have sufficient strength to support the roof (see FIG. 6). The strength issue becomes increasingly important as the pitch of the roof increases. However, there is no exact depth to which the seat cut should be made. It is a compromise between the necessary remaining strength of the finished rafter and a sufficiently deep cut to make the seat of the rafter to the top plate stable. Thus, as long as the same or a corresponding seat cut depth is used for all of the rafters that rest on the top plate, the pitch of the roof will be uniform.

In the example of FIG. 8, the depth of cut for the common rafter for a 6 and 12 pitch roof was selected to be 1¼″ to allow a 3″ horizontal surface 34 for the rafter to sit on the top plate 20. This was done on the template for both 2″×6″ and 2″×4″ stock. These depths are then transferred across to the hip and valley side of the template with the depth being for a valley or backed hip rafter. If an unbacked rafter is to be used, then the seat cut must be made deeper. The extra depth necessary is dependent on the actual thickness of the stock from which the hip rafters are to be cut. Measurements 108 represent one half the actual thickness of stock being used for the hip rafters and these measurements are marked off parallel to the seat level line 48. The additional depth required is then measured from the end of the appropriate measurement line 108 to the base line parallel to the hip and valley plumb line. In the example shown, the template was designed for two inch thick stock so the 5/16″ measurement is used to increase the depth of the unbacked hip seat cuts 46 and 48 measured perpendicularly to the base line.

Figure 6:
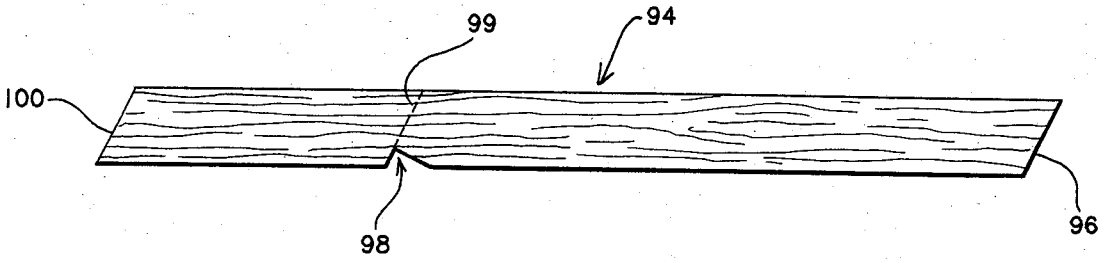
FIG. 6 is a plan view of a finished rafter.

Next, we will discuss the use of each of the two template embodiments of the present invention. Before getting into the details of that use a few terms will be described with the use of FIG. 6. In FIG. 6 a plan side view of a finished cut rafter 94 is shown. A top plumb cut 96 is shown at the right end of rafter 94, and this end, for other than common rafters, will include a miter or side cut since the top end of all rafters other than common rafters are not square against the roof component to which it joins (see FIG. 1). Also shown is a seat cut 98 where the rafter sits on top plate 20 (see FIG. 1). If the roof design does not extend beyond the top plate line, then the tail of the rafters would be cut along top plate plumb line 99. In the example rafter shown, it is cut to extend beyond the top plate 20 and shows the tail 100 being cut plumb, that is parallel to the top plumb cut. The tail cut can be whatever style desired, however, the plumb cut is often used to allow facia boards 18 to be added for mounting of rain gutters, for example.

Figure 7A:
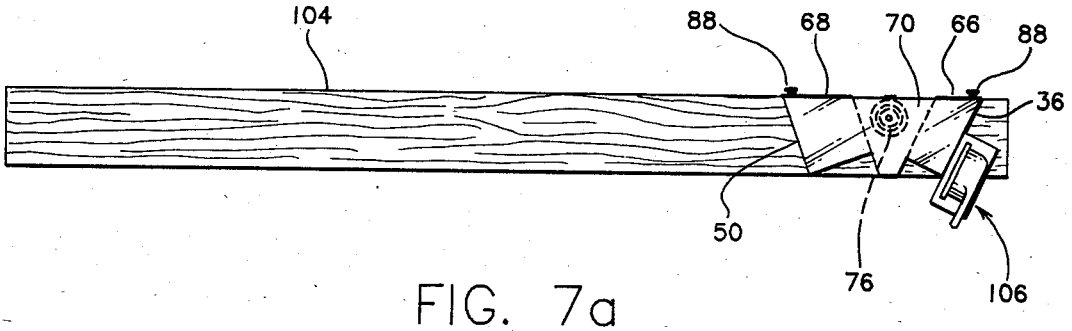
FIGS. 7*a–c* are plan views of stock with the template of the present invention placed thereon to demonstrate the cutting of a rafter of the type shown in FIG. 6.
Figure 7B:
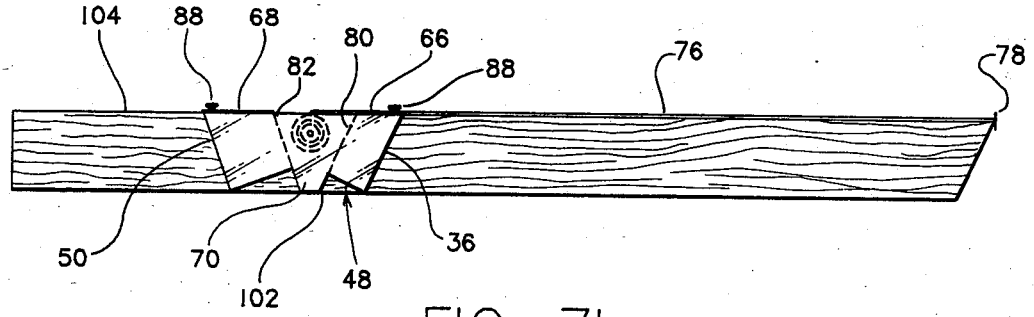
Figure 7C:
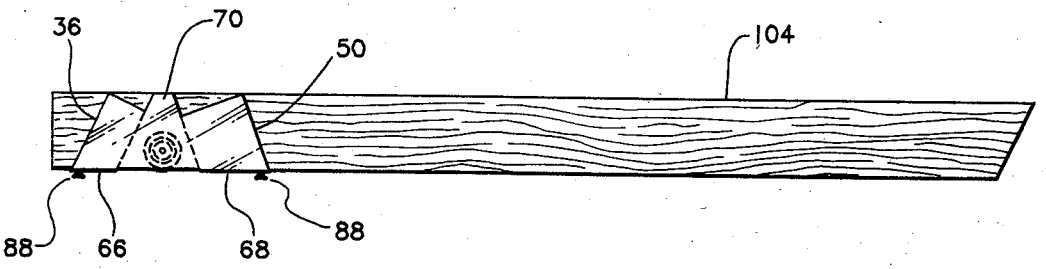

Referring next to FIGS. 7*a–c* a discussion of the use of a template of the second embodiment will be given. In FIG. 7*a* the template is shown in place on the side of the stock with miter wings 66 and 68 snug against the edge of the stock to be cut. If the rafter being cut is a common rafter, circular saw 106 is abutted against the appropriate plumb line guide and then advanced to make the top plumb cut 96. For rafters other than common rafters, the angle of the saw blade is set to the appropriate angle C or D from the corresponding miter wing 66 or 68 before the top plumb cut is made so that the appropriate side cut is made at the same time that the top plumb cut is made. Next, the zero pitch length of the rafter being cut is measured to the top plate on the zero pitch roof plan 10, and one half the width of the ridge, hip or valley component is subtracted from that length. Tape 76 is then extended in the direction of the plumb line guide used to make the top cut 96, hook 78 is hooked over the corner of the top plumb cut and the body 70 of the template moved to the left until the desired length of the rafter being cut appears on the expanded scale opposite the appropriate seat cut plumb line 80 or 82 at the rear edge of the rightmost miter wing (FIG. 7*b*). The appropriate seat cut is then marked on the stock. If the tail of the rafter is to extend beyond the top plate, then the zero pitch plan is again consulted and the template is again moved to the left until the new length appears on the expanded scale of tape 76 opposite the same seat cut plumb line, and the edge of the stock is marked opposite the rear of the rightmost miter wing. Now the template, keeping body 70 horizontal is turned 180° and the miter wings 66 and 68 abutted against the other edge of the stock, the same plumb line guide 36 or 50 used to cut the top plumb cut is either, aligned with the mark made on the top edge and a line marking the location tail cut made of the side of the stock so that the circular saw can be used to cut the tail, or aligned with the width of the saw base plate to the right of the mark on the top edge and the saw abutted the appropriate guide 36 or 50 to make the tail cut (FIG. 7*c*). For all tail cuts there is no side cut for either the common or jack rafters, and the tails of the hip and valley rafters are beveled as required if facia boards 18 are to be used. For hip rafters 14, the template is also used to mark the rafter for backing its top edge. This is done by placing the side of the main body 70 against the top edge of the rafter with the miter wings 66 and 68 snug against the side of the rafter. A pencil point is then inserted into the appropriate backing hole for the actual thickness of the stock being cut and the template is then drawn along the entire length of the rafter. The template is then turned 180° to place the miter wings 66 and 68 against the opposite side of the stock and that side is then marked as was the first side. Next, the center of the top edge of the hip rafter is marked along its entire length. The final step in the cutting of all rafters is the cutting out of the seat cut, and for hip rafters, the planing of the top edge of the rafter to create an inverted "V" shape with the edge center line defining the bottom point of the "V" and the side backing marks defining the two top points of the "V".

Note, that if more than one rafter of the same length is to be cut, then time would be saved by first cutting all of the top plumb cuts for those rafters, then the tape extended for the seat cut as described with tape 76 locked beneath plate 90 which is swiveled over it and held in place by wing nut 92, each piece of stock is then marked for the seat cut, and finally the tape is extended and locked in place for the tail cut, each piece of stock marked and then tape 76 is returned to body 70 before making the tail cut. With the use of tape 76 the stock can be measured to the necessary length using only the zero pitch plan measurement by means of the expanded scale without converting the zero pitch measurement to the actual length in standard inches since the expansion factor automatically accounts for the increased length as a result of the selected pitch of the roof. Further, if the carpenter wishes to determine the minimum length of the raw stock that he needs for a particular rafter, or rafters, given the zero pitch roof plan and the desired pitch of the roof, he need only withdraw tape 76 a sufficient distance to read the zero pitch length on the expanded scale of the template for that pitch and read the actual length in standard inch dimensions on the opposite standard scale of the tape. Finally cripple jack rafters 26 would be similarly cut except that the length would have to be reduced by one half the thickness of both the ridge and the valley, and the plumb cuts at both ends would have to be parallel, thus the template is not reversed when it is used to mark or cut the second plumb cut as for the other rafters.

The template of the first embodiment is used similarly to the second embodiment template by doing so with a separate measuring tape and use of the scale and charts on the appropriate side of the template to convert the zero pitch measurements to actual standard measurements for the selected pitch before that measurement is made.

From the foregoing description, it will be apparent that the invention disclosed herein provides novel and advantageous rafter template designs. As will be understood by those familiar with the art, the invention may be embodied in other specific forms without departing from the spirit or essential characteristics thereof.

What is claimed is:

1. A rafter cutting template and guide for laying out each type of roof rafter for a selected roof pitch given a zero pitch roof plan with the zero pitch length of all common, jack, cripple jack, valley jack, verge, hip, both backed and unbacked, and valley rafters, the template comprising:

a body portion having a straight top edge, a first side edge making a first acute included angle with one end of the top edge, a second side edge making a second acute included angle with the other end of the top edge, a first and a second seat cut guide surface each being at a right angle with the end of the first and second side edges, respectively, away from the top edge and extending toward each other, and first and second side edge extensions each being at a right angle with the first and second seat cut guide surfaces, respectively, and extending away from the top edge; and wing means attached perpendicularly to the body portion along the top edge thereof for abutting the stock from which the desired rafter is to be cut.

2. A rafter cutting template and guide of claim 1 wherein:

said first acute included angle is the same as the plumb cut angle for common, jack, cripple jack, valley jack and verge rafters for the selected roof pitch; and said second acute included angle is the same as the plumb cut angle for hip and valley rafters for the selected roof pitch.

3. A rafter cutting template and guide as in claim 2 wherein said wing means includes:

a first polyhedron wing affixed to the top edge flush with the junction of the one end of the top edge and first end of the body portion and extending away therefrom along the top edge, the first edge of the first wing furthest from the one end of the top edge being perpendicular to the side surfaces of the body portion, one end of a second and a third edge of the first wing being perpendicular to the first edge and extending toward said one end of the top edge of the body portion, the other end of the second and third edges joining a fourth and a fifth edge respectively with an included angle that corresponds to the side cut angle of jack, valley jack and cripple jack rafters for the selected roof pitch, and the fourth and fifth edges extend to the one end of the top edge of the body portion; and a second polyhedron wing affixed to the top edge flush with the junction of the other end of the top edge and second end of the body portion and extending away therefrom along the top edge, the first edge of the second wing furthest from the other end of the top edge being perpendicular to the side surfaces of the body portions, one end of a second and a third edges of the second wing being perpendicular to the first edge and extending toward said other end of the top edge of the body portion, the other end of the second and third edges joining a fourth and a fifth edge respectively with an included angle that corresponds to the necessary side cut angle of hip and valley rafters for the selected roof pitch, and the fourth and fifth edges extend to the other end of the top edge of the body portion;

for each of said first and second wings its first edge intersects the top edge of the body portion at the point where a line extension of the first and second side edge extensions, respectively, drawn up the side of the body portion, intersects the top edge.

4. A rafter cutting template and guide as in claim 1 further includes means affixed to the template for converting the zero pitch length of each rafter to an actual length for the selected roof pitch.

5. A rafter cutting template and guide as in claim 4 wherein the length converting means includes:

a first table equating integer foot values for common, jack, cripple jack, valley jack and verge rafters from the zero pitch roof plan to actual lengths for the selected roof pitch;

a second table equating integer foot values for hip and valley rafters from the zero pitch roof plan to actual lengths for the selected roof pitch;

a first scale means having a first set of divisions in standard inches and fractions thereof and a second set of divisions in expanded inches and fractions thereof, wherein the expanded inch divisions are expanded by the zero pitch to selected pitch expansion factor wherein each of the scale means are at least one expanded foot long for allowing for the conversion of the zero pitch length to actual length for zero pitch measurements of less than one foot for common, jack, cripple jack, valley jack and verge rafters; and a second scale means having a first set of divisions in standard inches and fractions thereof and a second set of divisions in expanded inches and fractions thereof, wherein the expanded inch divisions are expanded by the zero pitch to selected pitch expansion factor wherein each of the second scale means are at least one expanded foot long for allowing for the conversion of the zero pitch length to actual length for zero pitch measurements of less than one foot for hip and valley rafters.

6. A rafter cutting template and guide of claim 5 wherein:

said first acute included angle is the same as the plumb cut angle for common, jack, cripple jack, valley jack and verge rafters for the selected roof pitch; and said second acute included angle is the same as the plumb cut angle for hip and valley rafters for the selected roof pitch.

7. A rafter cutting template and guide as in claim 4 wherein the length converting means includes a rolled dual scale, dual sided tape affixed to the body portion of the template intermediate the first and second side edges of the body portion with the end of the tape disposed to extend adjacent the top edge to and beyond said one and other ends of the top edge, each side of said tape being marked with one set of divisions in standard inches and fractions thereof and another set of divisions in expanded inches and fractions thereof adjacent said one set of divisions, the expanded scale of the visible side of the tape when the tape is extended to and beyond said one and other ends of the top edge is expanded by a factor to convert the zero pitch length to the actual length for the selected roof pitch for the type of rafters to be cut using the end of the template to which the end of the tape is directed.

8. A rafter cutting template and guide of claim 7 wherein:

said first acute included angle is the same as the plumb cut angle for common, jack, cripple jack, valley jack and verge rafters for the selected roof pitch; and said second acute included angle is the same as the plumb cut angle for hip and valley rafters for the selected roof pitch.

9. A rafter cutting template and guide as in claim 7 further includes tape lock means affixed to each end of the top edge of the body portion disposed to lock the tape in an extended position for holding the tape in that extended position.

10. A rafter cutting template and guide as in claim 7 wherein the dual scales on each side of the dual sided tape each include the standard and expanded inch division marks on opposite sides of a single straight line for ease of conversion of a measurement using one set of divisions to the other set of divisions.

11. A rafter cutting template and guide as in claim 1 wherein said body portion further defines third and fourth seat cut guide surfaces each being parallel to the first and second seat cut guide surfaces, respectively, and being closer to the top edge, one end of each of said third and fourth seat cut guide surfaces extending to a line extension of the first and second side edge extensions, respectively, with a portion of said line extensions at the point of intersection with the respective one of the third and fourth seat cut guides disposed to be a guide surface.

12. A rafter cutting template and guide as in claim 11 wherein said second and fourth seat cut guides extend to a point closer to the top edge than the first and third seat cut guides, respectively, to allow for the marking of a deeper seat cut for hip rafters that are to be unbacked.

13. A rafter cutting template and guide as in claim 1 wherein said second seat cut guide extends to a point closer to the top edge than the first seat cut guide to allow for the marking of a deeper seat cut for hip rafters that are to be unbacked.

* * * * *